US008261493B2

(12) United States Patent
Hedrick

(10) Patent No.: US 8,261,493 B2
(45) Date of Patent: Sep. 11, 2012

(54) REMOVABLE RAIN GUTTER PROTECTION DEVICES AND RAIN GUTTERS INCORPORATING SAME

(75) Inventor: Shane Hedrick, Raleigh, NC (US)

(73) Assignee: Phalanx Gutter Guard, LLC, Raleigh, NC (US)

( * ) Notice: Subject to any disclaimer, the term of this patent is extended or adjusted under 35 U.S.C. 154(b) by 323 days.

(21) Appl. No.: 12/565,958

(22) Filed: Sep. 24, 2009

(65) Prior Publication Data

US 2011/0067317 A1 Mar. 24, 2011

(51) Int. Cl.
*E04D 13/00* (2006.01)

(52) U.S. Cl. ..... 52/12; 52/11; 52/14; 52/13; 52/16; 210/155; 210/474

(58) Field of Classification Search ..... 52/11, 12, 52/13, 14, 15, 16; 210/154, 155, 156, 459, 210/473, 474, 482
See application file for complete search history.

(56) References Cited

U.S. PATENT DOCUMENTS

| | | | | |
|---|---|---|---|---|
| 608,844 | A | 8/1898 | Dick | |
| 1,553,426 | A | 6/1924 | Altenbern et al. | |
| 4,307,976 | A | 12/1981 | Butler | |
| 4,467,570 | A | 8/1984 | Kriegel | |
| 5,406,754 | A | 4/1995 | Cosby | |
| 5,595,027 | A | 1/1997 | Vail | |
| 5,819,476 | A | 10/1998 | Annestedt, Sr. | |
| 6,016,631 | A | 1/2000 | Lowrie, III | |
| 6,067,755 | A | 5/2000 | Maanum | |
| 6,151,837 | A | 11/2000 | Ealer, Sr. | |
| 6,463,700 | B2 | 10/2002 | Davis | |
| 6,598,352 | B2 | 7/2003 | Higginbotham | |
| 6,681,527 | B2 | 1/2004 | Baker | |
| 6,904,718 | B2 | 6/2005 | Fox | |
| 7,174,688 | B2 | 2/2007 | Higginbotham | |
| 7,198,714 | B2 | 4/2007 | Swistun | |
| 7,310,912 | B2 | 12/2007 | Lenney et al. | |
| 7,340,863 | B1 | 3/2008 | Dressler | |
| 2002/0166290 | A1 | 11/2002 | Bergeron | |
| 2006/0265968 | A1 * | 11/2006 | Lowrie, III | 52/11 |
| 2007/0051051 | A1 | 3/2007 | Teichner et al. | |
| 2007/0119104 | A1 | 5/2007 | Pijanowski | |
| 2008/0016787 | A1 | 1/2008 | Marriner | |
| 2008/0163561 | A1 | 7/2008 | Lenney et al. | |

FOREIGN PATENT DOCUMENTS

| | | | |
|---|---|---|---|
| JP | 05209450 A | * | 8/1993 |
| JP | 09203169 A | | 8/1997 |

* cited by examiner

*Primary Examiner* — Robert Canfield
*Assistant Examiner* — Matthew Gitlin
(74) *Attorney, Agent, or Firm* — Myers Bigel Sibley & Sajovec, P.A.

(57) ABSTRACT

A gutter protection device includes an elongated frame having opposite first and second edge portions, opposite first and second end portions, an elongated recessed portion in a medial portion thereof, and one or more insert panels removably secured within the recessed portion. The recessed portion extends from the frame first end portion to the frame second end portion, and includes a plurality of gutter access openings arranged longitudinally in end-to-end spaced-apart relationship. Each insert panel is removably secured within the frame recessed portion, and includes opposite first and second edge portions, opposite end portions, and opposite upper and lower surfaces. Each panel includes a plurality of spaced-apart openings formed therethrough that permit water to flow into a rain gutter. A filtering screen is secured to the insert panel lower surface and covers the insert panel openings. The filtering screen is configured to prevent the passage of debris therethrough.

21 Claims, 12 Drawing Sheets

REMOVABLE RAIN GUTTER PROTECTION DEVICES AND RAIN GUTTERS INCORPORATING SAME

FIELD OF THE INVENTION

The present invention relates to rain gutters and, more particularly, to devices for preventing debris from collecting in rain gutters.

BACKGROUND

Rain gutters are narrow channels, or troughs, used to collect and divert rainwater shed by a roof. Water collected by a rain gutter typically is directed via a downspout to the base of a building (e.g., a residential home, office building, etc.) where the water is either discharged or collected. Rain gutters may protect the foundation of a building by channeling water away from the its base. Rain gutters may also help to reduce erosion, prevent leaks in basements and crawlspaces, and protect the outer surfaces of buildings by reducing exposure to water.

Unfortunately, rain gutters and downspouts connected thereto can become clogged with leaves, twigs, pine needles and other debris. In addition to impeding the flow of water, debris within a rain gutter may cause the rain gutter to sag because of the excess weight. This sagging can reverse the normal drainage slope of the gutter, thereby causing water to collect and stagnate within the gutter. Clogged gutters can cause water leakage into a building as the water backs up. As such, periodic cleaning is typically required to remove debris from rain gutters.

Various types of screens and covers (collectively referred to as gutter guards) have been developed to prevent leaves and other debris from collecting in rain gutters. Though these gutter guards may successfully exclude a great majority of the debris, it is still necessary to have access to the interior of a rain gutter for cleaning and other purposes. For easy access, gutter guards have been provided with various types of hinges and clips that allow the devices to be pivoted away and/or removed from a gutter. Unfortunately, such hinges and clips can become lost or damaged over time such that a gutter guard does not properly cover a rain gutter. In addition, strong winds, fallen limbs, and even small animals, such as birds, squirrels and the like, may damage gutter guards. Thus, there remains a need for gutter guards that can remain in place and serve their function, while allowing for quick and easy removal for rain gutter access to facilitate maintenance and cleaning.

SUMMARY

It should be appreciated that this Summary is provided to introduce a selection of concepts in a simplified form, the concepts being further described below in the Detailed Description. This Summary is not intended to identify key features or essential features of this disclosure, nor is it intended to limit the scope of the invention.

According to some embodiments of the present invention, a gutter protection device includes an elongated frame having opposite first and second edge portions, opposite first and second end portions, an elongated recessed portion in a medial portion thereof, and one or more insert panels removably secured within the recessed portion. The frame first edge portion has a planar configuration and the second edge portion has a convex or rounded configuration. The recessed portion of the frame extends from the first end portion to the second end portion, and includes a plurality of maintenance ports that are referred to herein as gutter access openings and which are arranged longitudinally in end-to-end spaced-apart relationship. When installed over a rain gutter, the frame first edge portion is inserted between the roof of a building and the last row of shingles such that the frame extends laterally across the rain gutter open top and longitudinally along the length of the rain gutter so that the gutter access openings are in fluid communication with the rain gutter. In addition, the frame second edge portion is positioned closely adjacent to a front edge of the rain gutter such that water flowing over the gutter protection device can flow around the second edge portion, due to surface tension, and into the rain gutter.

Each insert panel is removably secured within the frame recessed portion and has opposite first and second edge portions, opposite end portions, and opposite upper and lower surfaces. Each panel includes a plurality of spaced-apart openings formed therethrough that permit water to flow into a rain gutter. In some embodiments, the openings may be elongated slots arranged substantially parallel to one another.

A filtering screen is secured to the insert panel lower surface and covers the insert panel openings. The filtering screen is configured to prevent the passage of debris therethrough. The filtering screen may have openings of various sizes. For example, in some embodiments, the filtering screen may be about 16 mesh. In other embodiments, a finer mesh filtering screen may be utilized (e.g., between 20 mesh and 80 mesh, etc.) to prevent the passage of small particles, such as shingle grit, therethrough.

In some embodiments, the frame recessed portion includes a first plurality of slots arranged in longitudinally spaced-apart relationship on one side of the gutter access openings, and a second plurality of slots arranged in longitudinally spaced-apart relationship on an opposite side of the gutter access openings. Each insert includes a first plurality of tabs extending from the insert panel lower surface in longitudinally spaced-apart relationship and a second plurality of tabs extending from the insert panel lower surface in longitudinally spaced-apart relationship. The first plurality of tabs are positioned adjacent to the insert panel first edge portion and are configured to interlock with the first plurality of slots, and the second plurality of tabs are positioned adjacent to the insert panel second edge portion and are configured to interlock with the second plurality of slots.

In some embodiments, the frame second edge portion is secured to a gutter via a plurality of clips. Each clip has a first end shaped to be attached to the frame second edge portion and a second end shaped to fit into a lip of a rain gutter.

According to other embodiments of the present invention, a gutter protection device may be an integral part of a rain gutter. For example, a rain gutter includes a rear wall, a front wall, and a bottom wall, with the rear, front and bottom walls defining a trough therebetween for receiving water from a roof. A frame extends between the front wall and rear wall to cover the trough. The frame has an elongated recessed portion in a medial portion thereof, and includes a plurality of gutter access openings arranged longitudinally in end-to-end spaced-apart relationship. A plurality of inserts are removably secured within the recessed portion in end to end relationship. Each insert includes an elongated panel having opposite first and second edge portions, opposite first and second end portions, and opposite upper and lower surfaces. In addition, each insert panel includes a plurality of spaced-apart openings that permit water to flow into the gutter. A filtering screen is secured to each insert panel lower surface and covers all of the insert panel openings and prevents the passage of debris therethrough.

Embodiments of the present invention have numerous advantages over conventional gutter protection devices. Gutter protection devices according to embodiments of the present invention include a body or frame that remains in place over a rain gutter and that includes access ports to facilitate cleaning and maintenance of a rain gutter. These access ports, also referred to as gutter access openings, are readily exposed by easy removal of insert panels.

It is noted that aspects of the invention described with respect to one embodiment may be incorporated in a different embodiment although not specifically described relative thereto. That is, all embodiments and/or features of any embodiment can be combined in any way and/or combination. Applicant reserves the right to change any originally filed claim or file any new claim accordingly, including the right to be able to amend any originally filed claim to depend from and/or incorporate any feature of any other claim although not originally claimed in that manner. These and other objects and/or aspects of the present invention are explained in detail in the specification set forth below.

DETAILED DESCRIPTION

Figure 1A:
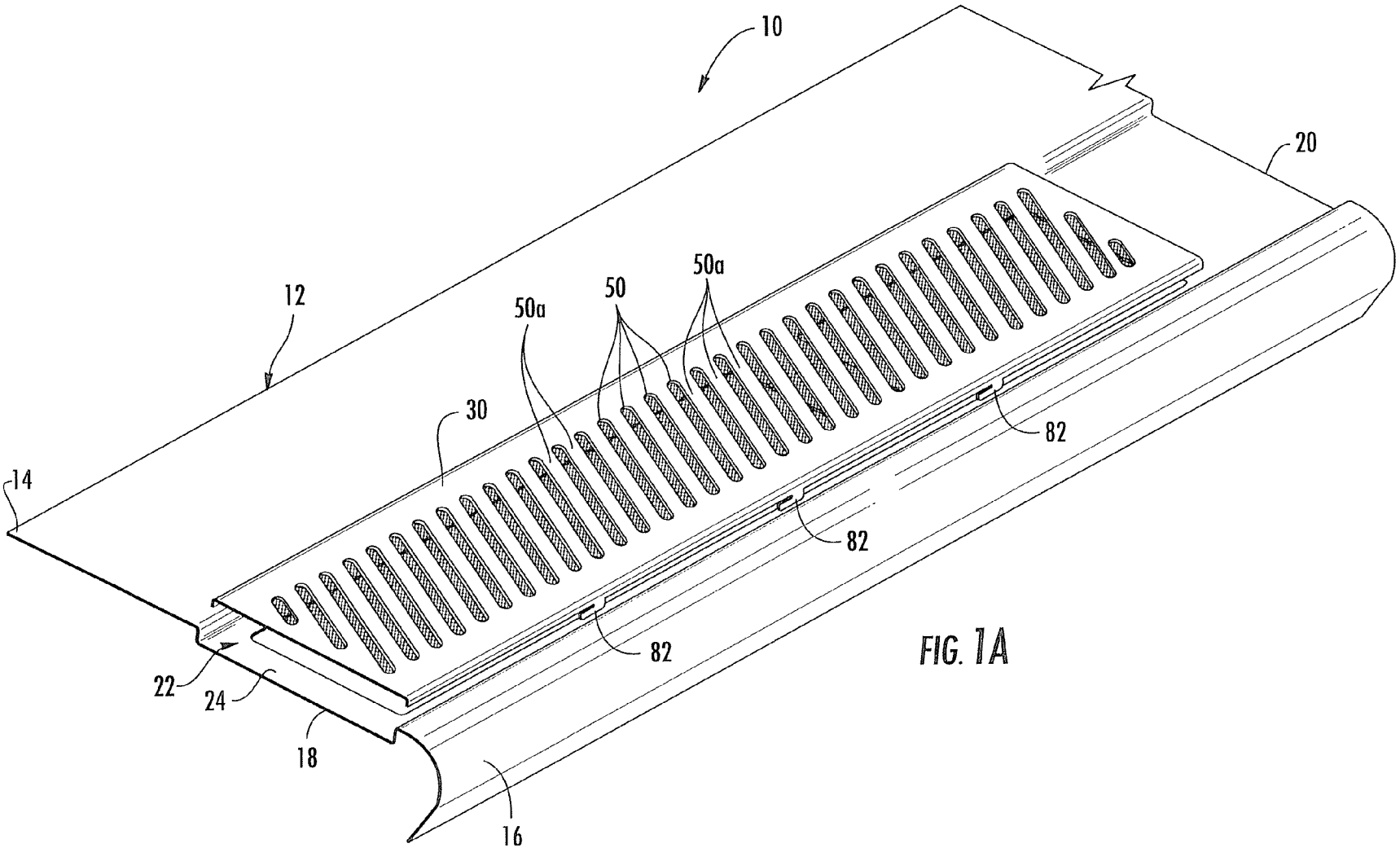
FIG. 1A is an exploded front perspective view of a rain gutter protection device, according to some embodiments of the present invention.

The present invention will now be described more fully hereinafter with reference to the accompanying figures, in which embodiments of the invention are shown. This invention may, however, be embodied in many different forms and should not be construed as limited to the embodiments set forth herein. Like numbers refer to like elements throughout. In the figures, certain layers, components or features may be exaggerated for clarity, and broken lines illustrate optional features or operations unless specified otherwise. In addition, the sequence of operations (or steps) is not limited to the order presented in the figures and/or claims unless specifically indicated otherwise. Features described with respect to one figure or embodiment can be associated with another embodiment of figure although not specifically described or shown as such.

It will be understood that when a feature or element is referred to as being "on" another feature or element, it can be directly on the other feature or element or intervening features and/or elements may also be present. In contrast, when a feature or element is referred to as being "directly on" another feature or element, there are no intervening features or elements present. It will also be understood that, when a feature or element is referred to as being "connected", "attached" or "coupled" to another feature or element, it can be directly connected, attached or coupled to the other feature or element or intervening features or elements may be present. In contrast, when a feature or element is referred to as being "directly connected", "directly attached" or "directly coupled" to another feature or element, there are no intervening features or elements present. Although described or shown with respect to one embodiment, the features and elements so described or shown can apply to other embodiments.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof. As used herein, the term "and/or" includes any and all combinations of one or more of the associated listed items.

Spatially relative terms, such as "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if a device in the figures is inverted, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly. Similarly, the terms "upwardly", "downwardly", "vertical", "horizontal" and the like are used herein for the purpose of explanation only unless specifically indicated otherwise.

It will be understood that although the terms first and second are used herein to describe various features and elements, these features and elements should not be limited by these terms. These terms are only used to distinguish one feature or element from another feature or element. Thus, a first feature or element discussed below could be termed a second feature or element, and similarly, a second feature or element discussed below could be termed a first feature or element without departing from the teachings of the present invention. Like numbers refer to like elements throughout.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the specification and relevant art and should not be interpreted in an idealized or overly formal sense unless expressly so defined herein. Well-known functions or constructions may not be described in detail for brevity and/or clarity.

Turning now to the figures, FIG. 1A illustrates an example of a rain gutter protection device 10 configured to be mounted in an open top of a rain gutter, according to some embodiments of the present invention. Gutter protection devices, according to embodiments of the present invention, provide excellent protection against the accumulation of debris within gutters. In addition, due to the fact that some debris collection is inevitable, and because maintenance is sometimes necessary, rain gutter protection devices, according to embodiments of the present invention, allow for quick and easy rain gutter access.

Figure 2:
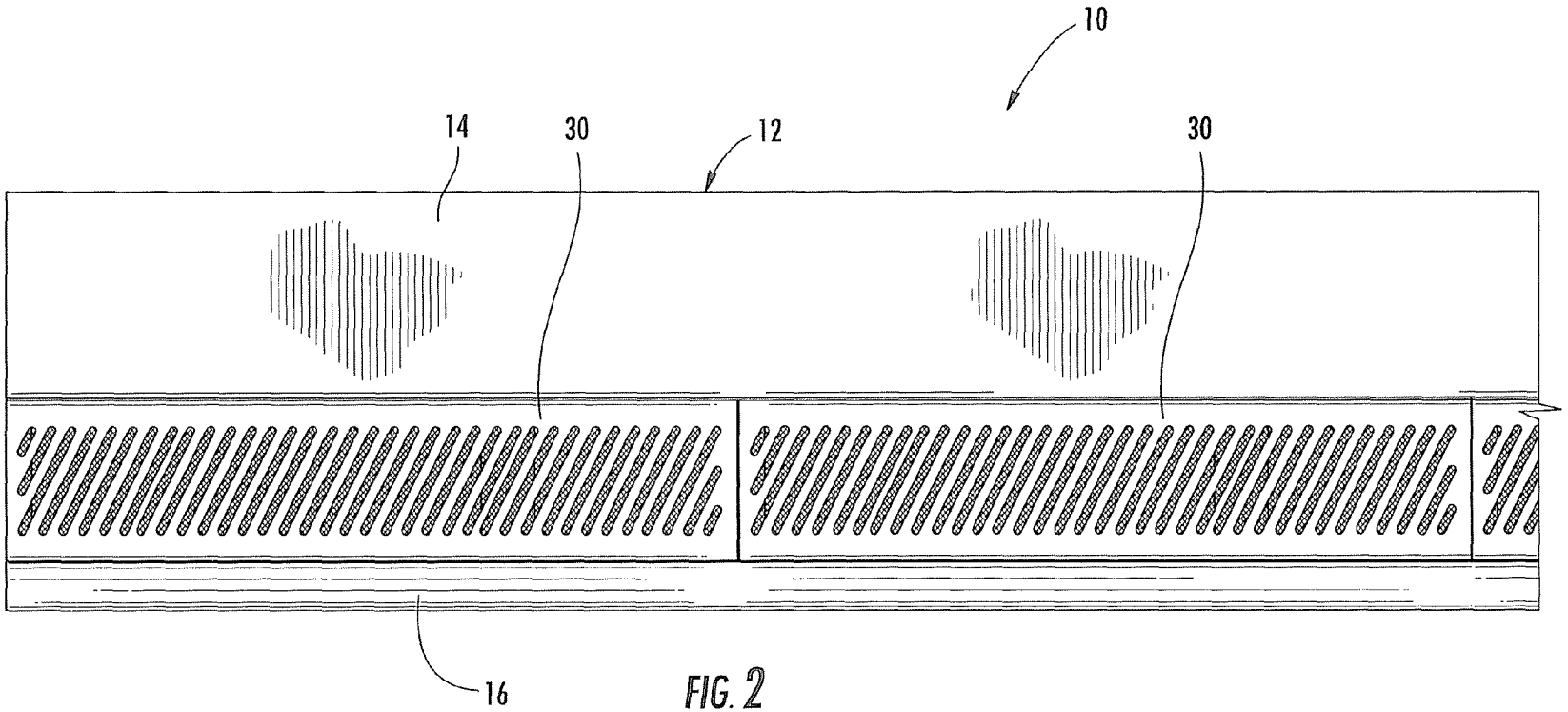
FIG. 2 is a top plan view of the rain gutter protection device of FIG. 1A with a plurality of insert panels removably secured within the frame in end-to-end relationship.

The illustrated gutter protection device 10 includes an elongated frame 12 having opposite first and second edge portions 14, 16, opposite first and second end portions 18, 20, and an elongated recessed portion 22 in a medial portion 24 of the frame 12, and at least one insert 30 removably secured within the recessed portion 22. The frame 12 may have any length. In some embodiments, the frame 12 has the same length as each straight section of a rain gutter mounted on a building. In other embodiments, the frame 12 is provided in unit lengths, such as, for example, a four foot section, an eight foot section, etc. Depending on the length of the frame 12, one or more insert panels 30 are removably secured within the frame 12. Each insert panel 30 is a unit length, such as, for example, a three foot panel, a four foot panel, etc., to facilitate removal thereof from the frame so that access to the rain gutter can be obtained. However, embodiments of the present invention are not limited to any particular length for insert panels 30 or to any particular length for frame 12. FIG. 2 illustrates a frame 12 with multiple insert panels 30 removably secured thereto in end to end relationship.

Figure 3:
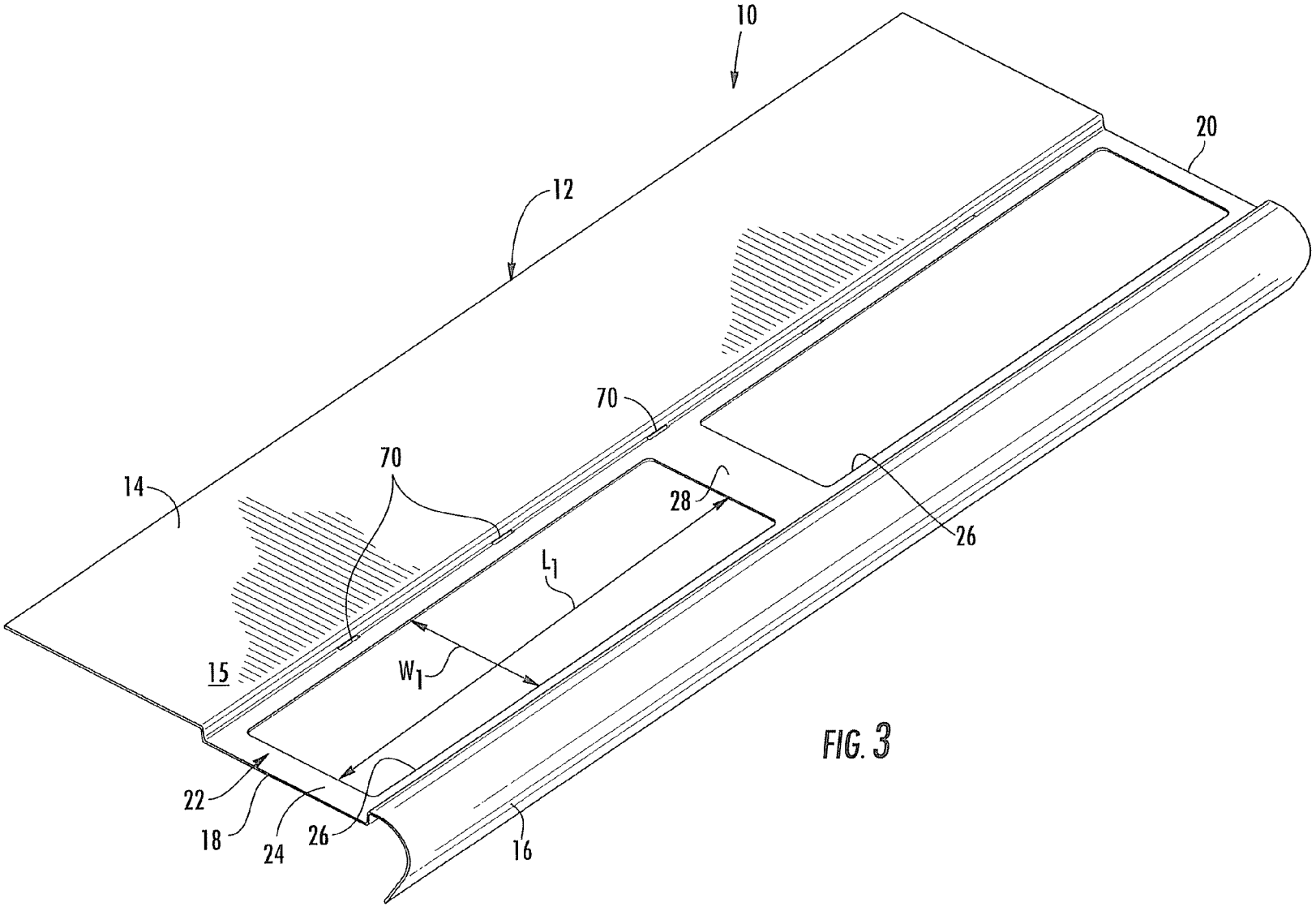
FIG. 3 is a front perspective view of the frame of the rain gutter protection device of FIGS. 1A and 1B, according to some embodiments of the present invention.
Figure 6:
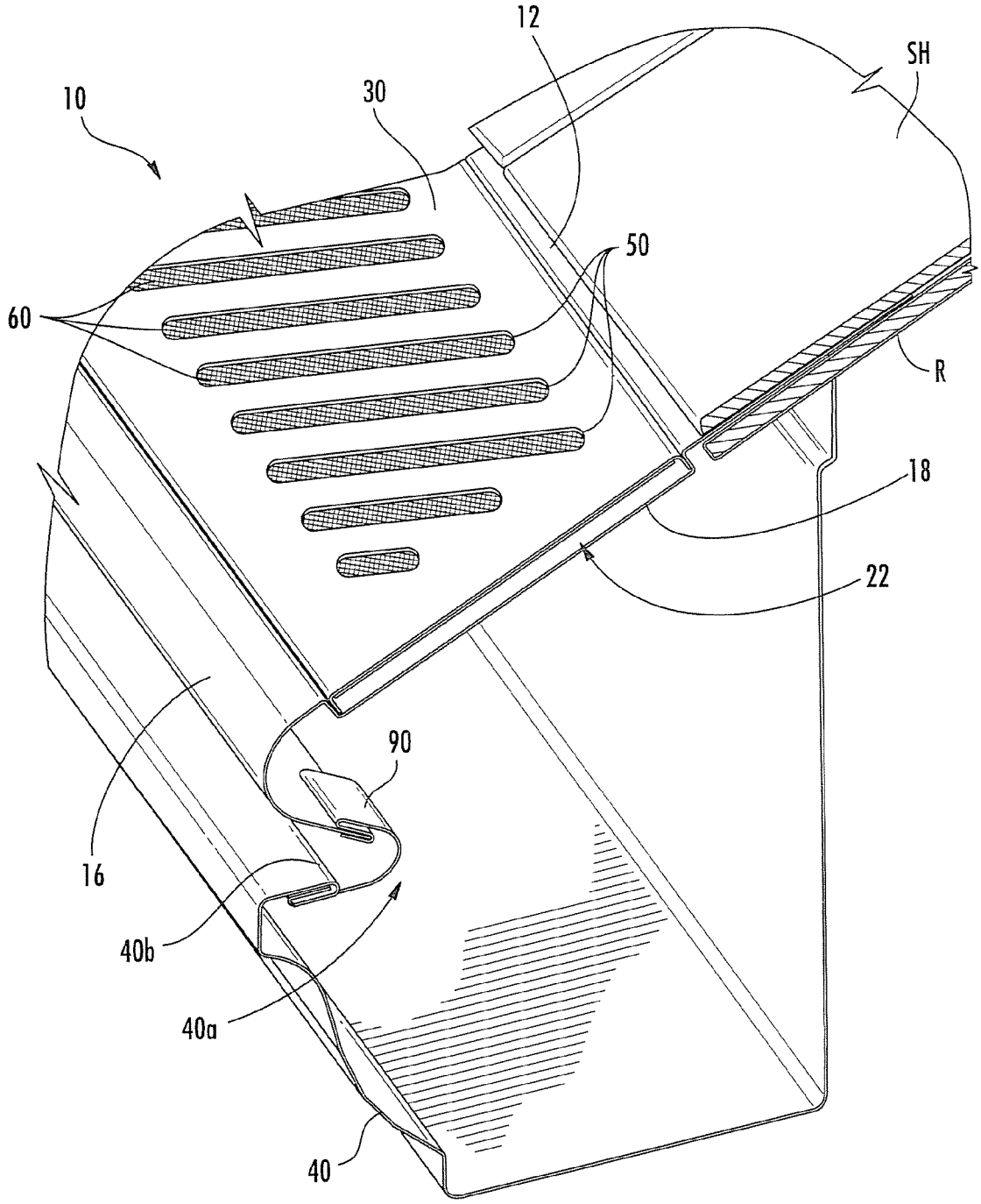
FIG. 6 is a side perspective view of the rain gutter protection device of FIG. 1A in an installed configuration, according to some embodiments of the present invention.

Referring to FIG. 3, the frame 12 of rain gutter protection device 10 is illustrated without any insert panels 30. The frame first edge portion 14 has a planar configuration and the second edge portion 16 has a convex or rounded configuration, as illustrated. The recessed portion 22 of the frame 12 extends from the first end portion 18 to the second end portion 20, and includes a plurality of gutter access openings 26 arranged longitudinally in end-to-end spaced-apart relationship. Adjacent gutter access openings 26 are separated by a rib member 28 within the recessed portion 22. When installed over a rain gutter 40, the frame first edge portion 14 is inserted between the roof of a building and the last row of shingles (or other roofing materials) such that the frame 12 extends laterally across the rain gutter open top 40*a* and longitudinally along the length of the rain gutter 40 so that the gutter access openings 26 are in fluid communication with the rain gutter 40, as illustrated in FIGS. 6 and 7. In addition, the frame second edge portion 16 is positioned closely adjacent to a front edge 40*b* of the rain gutter 40 such that water flowing over the gutter protection device can flow around the second edge portion, due to surface tension, and into the rain gutter 40.

In the illustrated embodiment, the frame recessed portion 22 has a rectangular configuration, and the insert panels 30 have a corresponding rectangular configuration. However, embodiments of the present invention are not limited to a rectangular configuration for the recessed portion 22 and the insert panels 30. Various corresponding shapes and configurations may be utilized for the recessed portion 22 and insert panels 30, without limitation.

Each gutter access opening 26 in the frame recessed portion 22 is large enough to allow for gutter cleaning and maintenance. For example, each gutter access opening 26 is large enough to allow a user to insert a hand and/or tool within a rain gutter 40 to facilitate cleaning and maintenance of the rain gutter 40. In the illustrated embodiment, each gutter access opening 26 has a substantially rectangular configuration with a width $W_1$ of, for example, between about 1 inch and about 6 inches, and a length $L_1$ of, for example, between about 6 inches and about 24 inches. However, gutter access openings 26 may have various lengths and widths, without limitation. Moreover, embodiments of the present invention are not limited to any particular size or configuration of gutter access openings 26.

Figure 4:
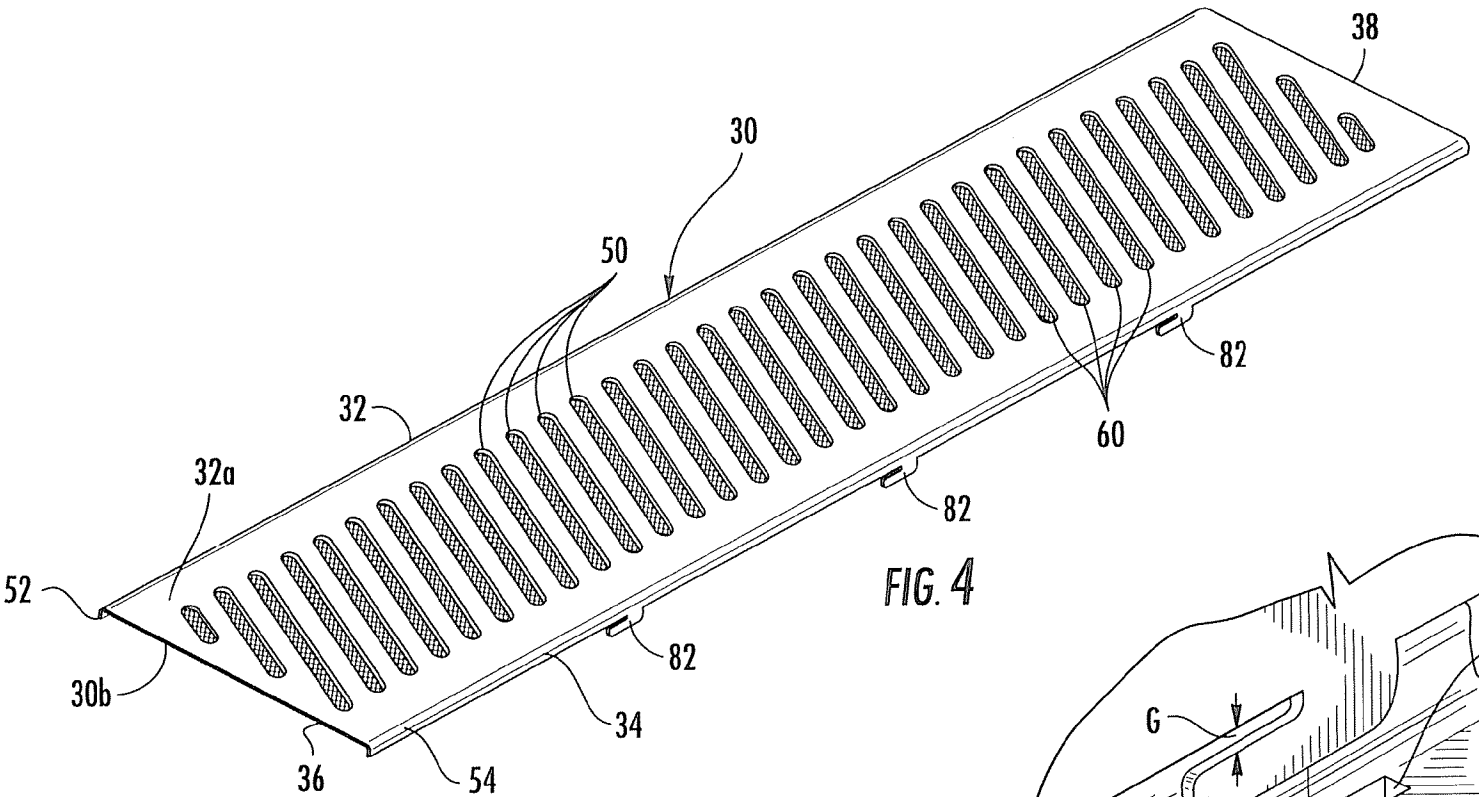
FIG. 4 is a top perspective view of an insert panel of the rain gutter protection device of FIG. 1A, according to some embodiments of the present invention.

Each insert panel 30 is removably secured within the recessed portion 22, and has opposite first and second edge portions 32, 34, opposite end portions 36, 38 and opposite upper and lower surfaces 30*a*, 30*b*, as illustrated in FIG. 4. Each panel 30 includes a plurality of spaced-apart openings 50 formed therethrough that permit water to flow into a rain gutter 40. In the illustrated embodiment, each insert panel 30 includes an elongated first wall 52 that extends outwardly from the insert panel lower surface 30*b* along the panel first edge portion 32, and an elongated second wall 54 that extends outwardly from the insert panel lower surface 30*b* along the panel second edge portion 34. The first and second walls 52, 54 are dimensioned to maintain the insert panel upper surface 30*a* substantially flush with an upper surface 15 of the elongated frame, as illustrated in FIG. 7. By having the panel upper surface 30*a* substantially flush with the frame upper surface 15, the flow of water is not impeded or diverted from flowing over the panel openings 50 and frame second edge portion 16. The first and second walls 52, 54 also serve as stiffening members that provide structural rigidity to the insert panel 30. However, in some embodiments, an insert panel 30 may be configured such that the panel upper surface 30*a* is slightly below the surface 15 of frame 12. In other embodiments, the insert panel 30 may have an arcuate configuration such that the insert panel 30 bows slightly upward away from the frame 12.

Figure 1B:
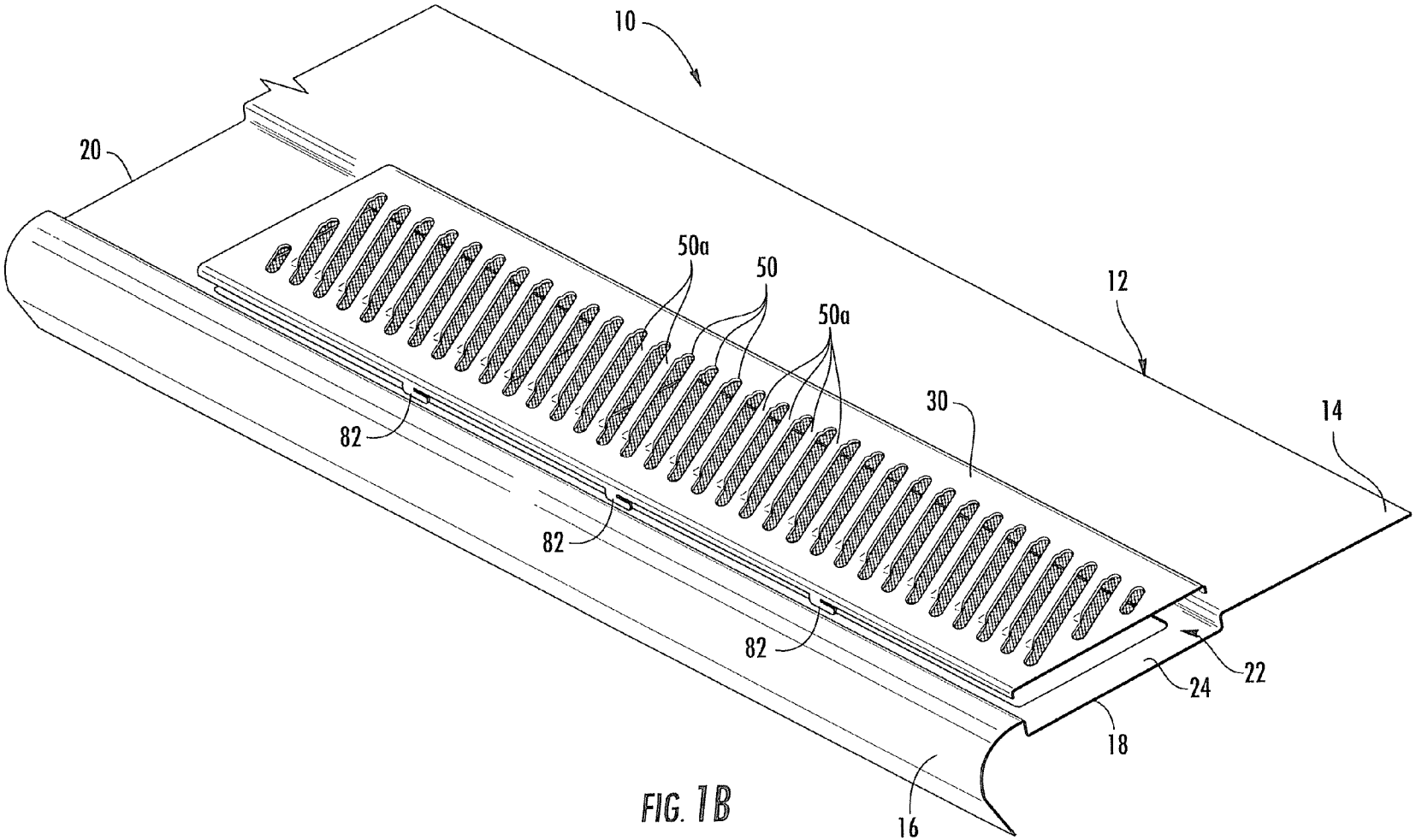
FIG. 1B is an exploded front perspective view of a rain gutter protection device, according to some embodiments of the present invention.

In the illustrated embodiment of FIGS. 1A and 4, the insert panel openings 50 are elongated slots that are arranged substantially parallel to one another and that extend at an acute angle relative to the insert panel first edge portion 32. The portions 50*a* between adjacent slots 50 in the illustrated embodiment of FIGS. 1A and 4 are substantially flat and lie in substantially the same plane as the panel 30. However, as illustrated in FIG. 1B, the portions 50*a* between adjacent slots 50 are rotated or bent relative to the panel 30 and do not lie in substantially the same plane as the panel 30. The configuration of portions 50*a* between adjacent slots 50 illustrated in FIG. 1B can facilitate directing water flowing over the panel 30 into the slots 50.

Figure 11:
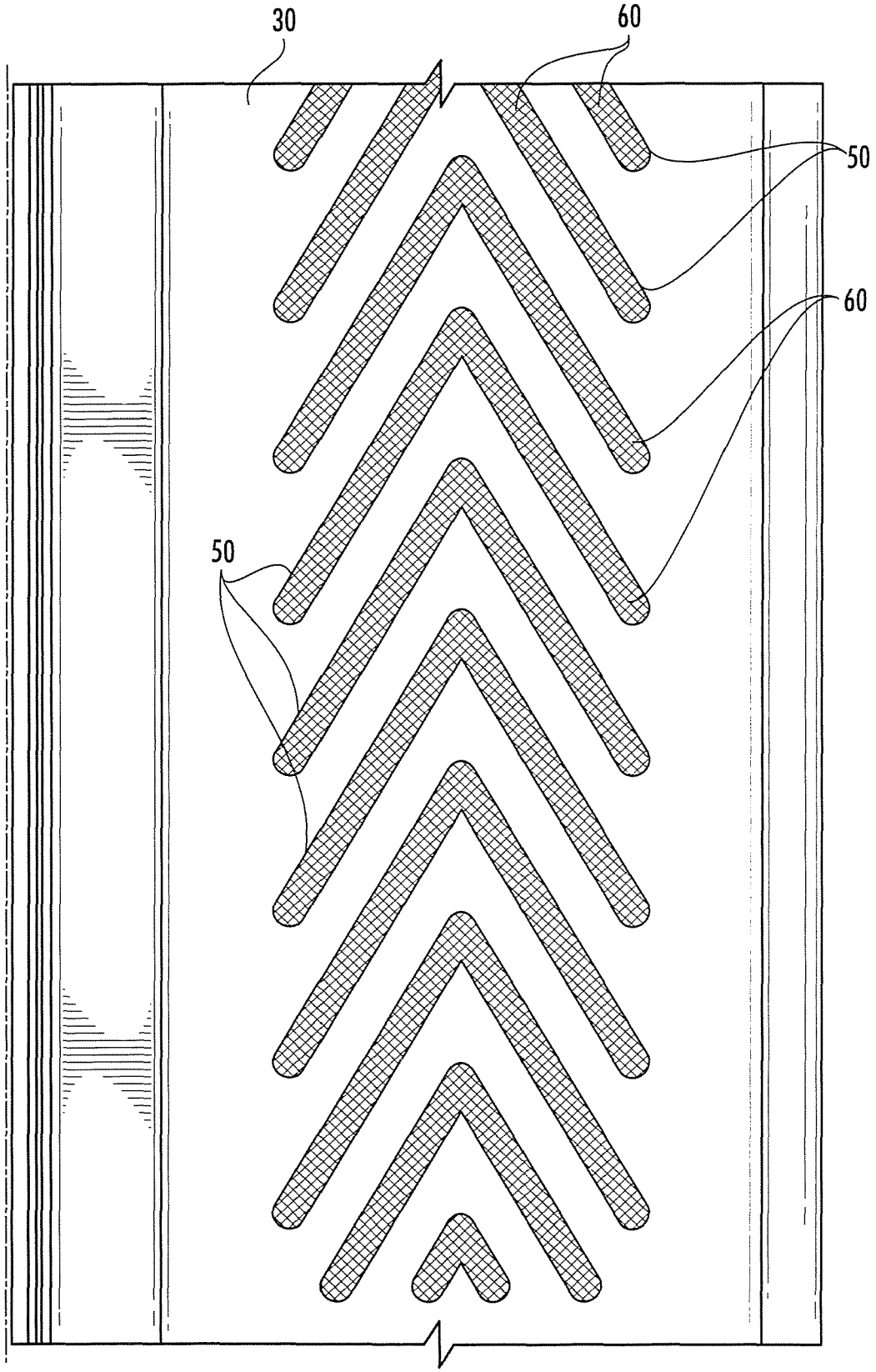
FIG. 11 is a partial top plan view of a rain gutter protection device, according to some embodiments of the present invention, and illustrating "V-shaped" slots in the removable insert panel thereof.

In some embodiments, the panel slots 50 may extend at an angle of between about 30° and 60° relative to the insert panel first edge portion 32. For example, in the embodiments of FIGS. 1A-1B, 2 and 4, the panel slots 50 extend at an angle of about 60° relative to the insert panel first edge portion 32. However, embodiments of the present invention are not limited to the illustrated slot configuration or to the illustrated angle of the slots 50. Moreover, in other embodiments, the slots 50 need not be parallel to each other. For example, as illustrated in FIG. 11, slots 50 may have a "V-shaped" configuration.

In the illustrated embodiment, a filtering screen 60 is secured to the insert panel lower surface 30*b* and covers the insert panel openings 50. The filtering screen 60 may be attached to the panel lower surface 30*b* in various ways. For example, the filtering screen 60 may be adhesively attached to the panel lower surface 30*b*. The filtering screen 60 is configured to prevent the passage of debris therethrough. The filtering screen 60 may have openings of various sizes. For example, in some embodiments, the filtering screen may be about 16 mesh (e.g., what is used in window and porch screens). In other embodiments, a finer mesh filtering screen may be utilized (e.g., between 20 mesh and 80 mesh, etc.) to prevent the passage of small particles, such as shingle grit, therethrough. For example, 60 mesh is the size commonly used in kitchen faucets. However, embodiments of the present invention are not limited to a filtering screen having a particular mesh.

By positioning the filtering screen 60 on the panel lower surface 30*b*, the filtering screen 60 is protected from potential damage by objects, such as limbs. In addition, the filtering screen 60 is protected from being removed from the panel as a result of wind gusts. Filtering screen 60 may be a metal mesh screen (e.g., copper, brass, bronze, stainless steel, aluminum, etc), a polymeric material mesh screen (e.g., nylon, polyvinyl chloride, polyethylene, polypropylene, polyester, etc.), or a combination of metal and polymeric material mesh screen.

The panel slots 50 may have various widths. For example, in some embodiments, the width of panel slots 50 may be between about one-half inch and one-quarter inch. However, various widths are possible without limitation. In some embodiments, the width of panel slots 50 may be decreased such that a filtering screen 60 is not required. For example, panel slots 50 may have a width less than or equal to about one-quarter inch, less than or equal to about one-eighth inch, etc.

Referring back to FIG. 3, the frame recessed portion 22 includes a first plurality of slots 70 arranged in longitudinally spaced-apart relationship on one side of the gutter access openings 26, a second plurality of slots 72 arranged in longitudinally spaced-apart relationship on an opposite side of the gutter access openings 26. Each insert panel 30 includes a first plurality of tabs 80 extending from the insert panel lower surface 30*b* in longitudinally spaced-apart relationship and a second plurality of tabs 82 extending from the insert panel lower surface 30*b* in longitudinally spaced-apart relationship, as illustrated. The first plurality of tabs 80 are positioned adjacent to the insert panel first edge portion 32 and are configured to interlock with the first plurality of slots 70, and the second plurality of tabs 82 are positioned adjacent to the insert panel second edge portion 34 and are configured to interlock with the second plurality of slots 72. The interlocking of tabs 80, 82 with respective slots 70, 72 allows the insert panel 30 to be removably secured within the recessed portion 22 of the frame 12.

Figure 5:
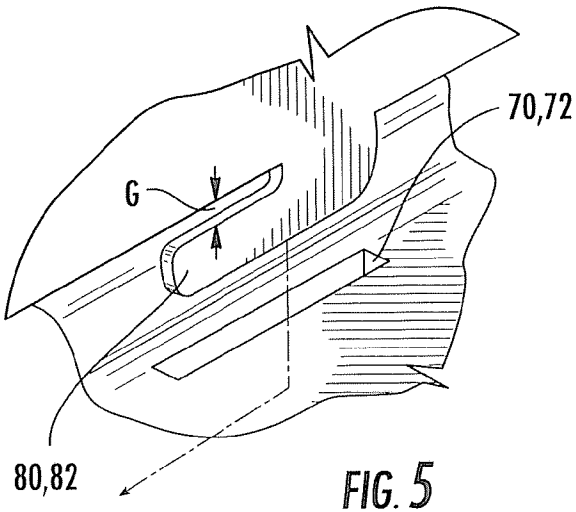
FIG. 5 is a partial enlarged view of a tab configured to removably secure an insert panel to the frame of the rain gutter protection device of FIGS. 1A and 1B, according to some embodiments of the present invention.

In the illustrated embodiment, each tab 80, 82 is "L" shaped with a free end portion. As illustrated in FIG. 5, a gap G exists between the free end portion of each tab and a free end of a respective wall from which the tab depends. This gap G is slightly larger than a thickness of the frame adjacent each slot 70, 72, and is configured to receive a portion of the frame 12 therein. The gap G may be selected such that there is a substantially snug fit or a somewhat loose fit between the tab gap G and the frame 12. Regardless, the configuration of tabs 80, 82 and slots 70, 72 allow each insert panel 30 to be removably secured to a frame and prevents the insert panel 30 from being removed by strong gusts of wind, limbs, and other objects.

Figure 7A:
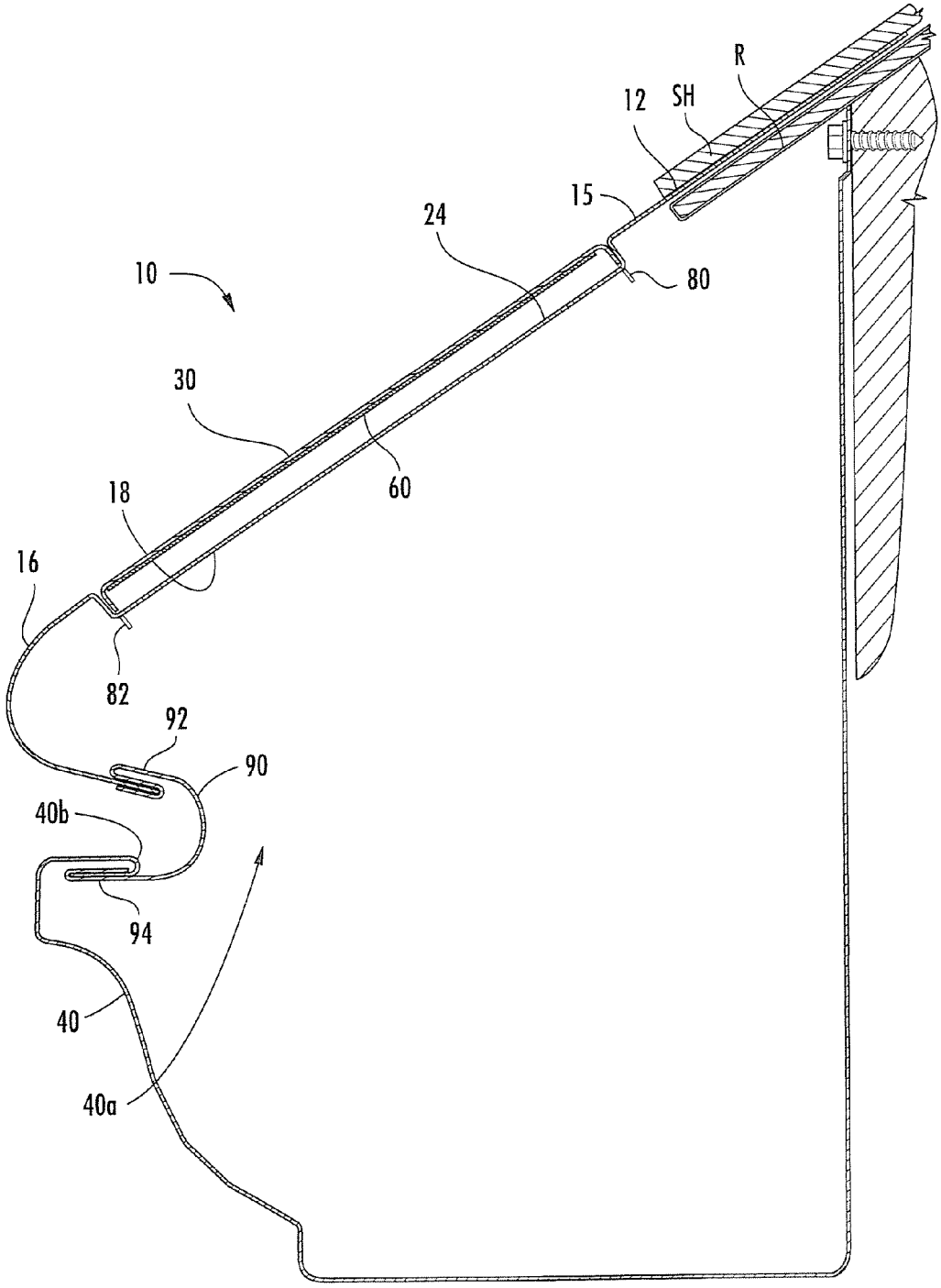
FIG. 7A is a side cross-sectional view of the rain gutter protection device of FIG. 1A in an installed configuration, according to some embodiments of the present invention.
Figure 8A:
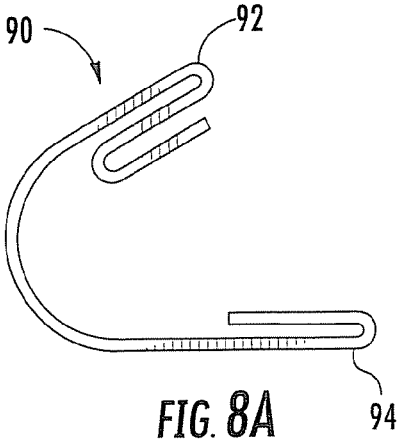
FIG. 8A is a side view of a clip for securing the frame of the rain gutter protection device of FIGS. 1A and 1B to a gutter, according to some embodiments of the present invention.
Figure 8B:
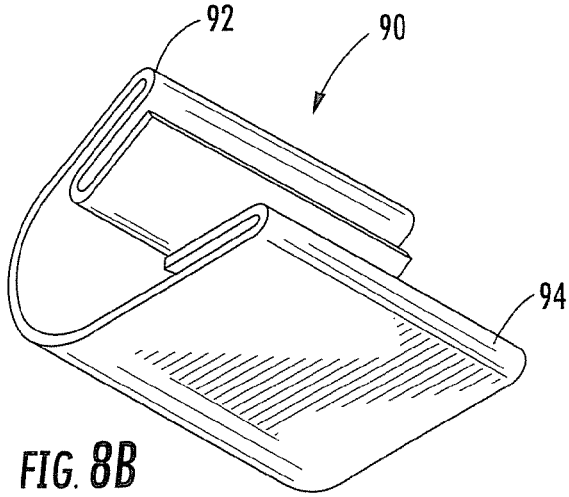
FIG. 8B is a side perspective view of the clip of FIG. 8A.

Referring now to FIGS. 6 and 7A, the gutter protection device 10 of FIGS. 1A and 2-5 is illustrated in an installed configuration on a rain gutter 40. The frame first edge portion 14 is positioned between the roof R of a building and the last row of shingles SH and the frame second edge portion 16 is positioned closely adjacent to a front edge 40*b* of the rain gutter 40. The frame second edge portion 16 is secured to the gutter 40 via a plurality of clips 90. Each clip 90 has a generally arcuate shape with first and second ends 92, 94, as illustrated in FIGS. 8A-8B. The first end 92 of each clip 90 is shaped to be attached to the frame second edge portion 16 and the second end 94 of each clip 90 is shaped to fit into the front edge 40*b* of the rain gutter 40. In the illustrated embodiment, clip first end 92 has an "S" shape and clip second end 94 has a "U" shape. However, various types of clips 90 with various configurations may be utilized for securing the frame second end portion 16 to a rain gutter 40. Embodiments of the present invention are not limited to the illustrated clip 90.

The frame 12, insert panels 30 and clips 90 of the illustrated gutter protection device 10 may be formed from various types and combinations of materials. For example the frame 12, insert panels 30 and clips 90 may be formed from metal, such as aluminum, and various types of polymeric materials. In some embodiments, the frame 12 may be formed from one type of material and the inserts may be formed from other types of material (e.g., aluminum frame 12 and plastic insert panel 30; plastic frame 12 and aluminum insert 30, etc.).

Figure 7B:
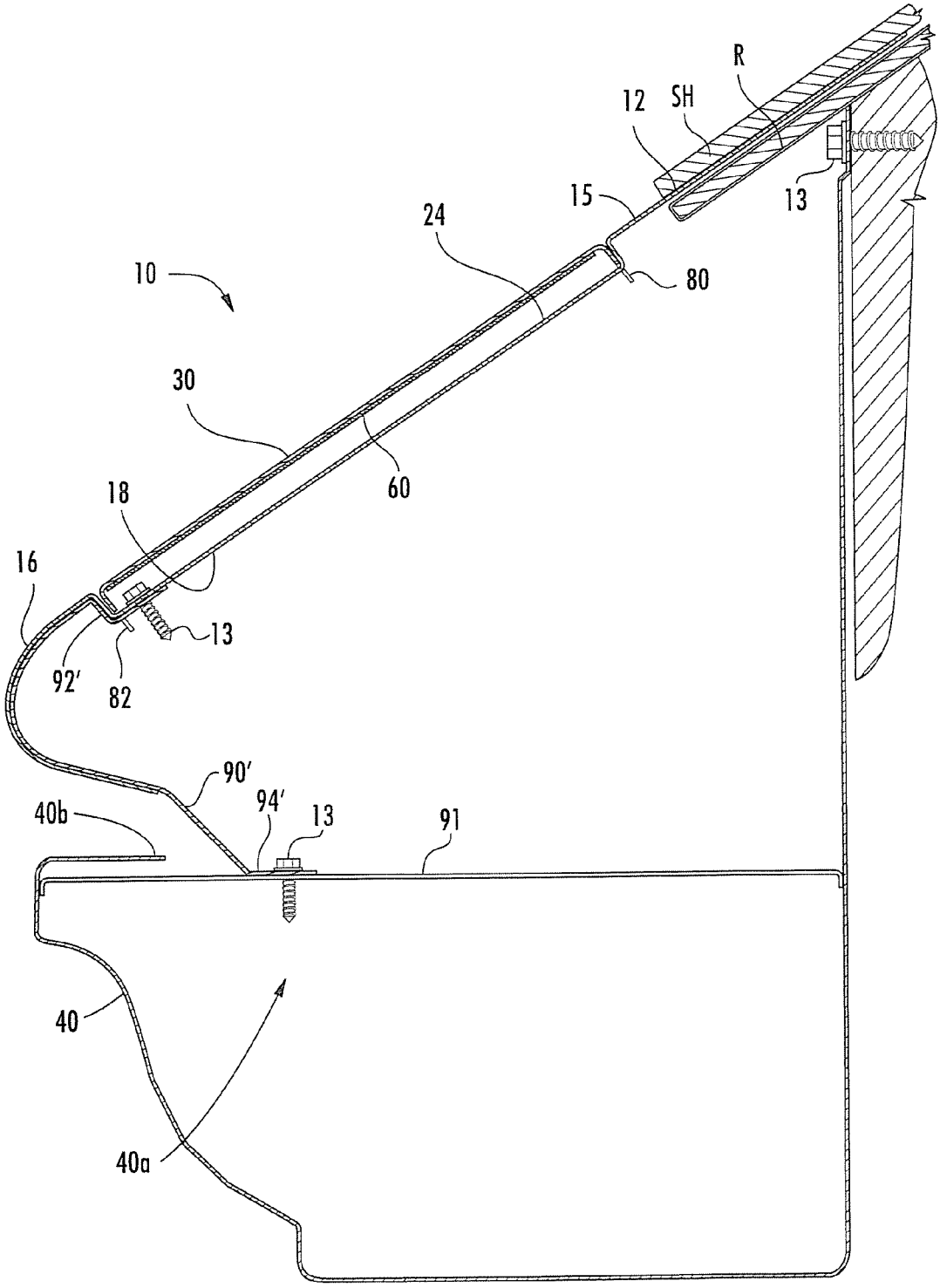
FIG. 7B is a side cross-sectional view of the rain gutter protection device of FIG. 1A in an installed configuration, according to some embodiments of the present invention.
Figure 7C:
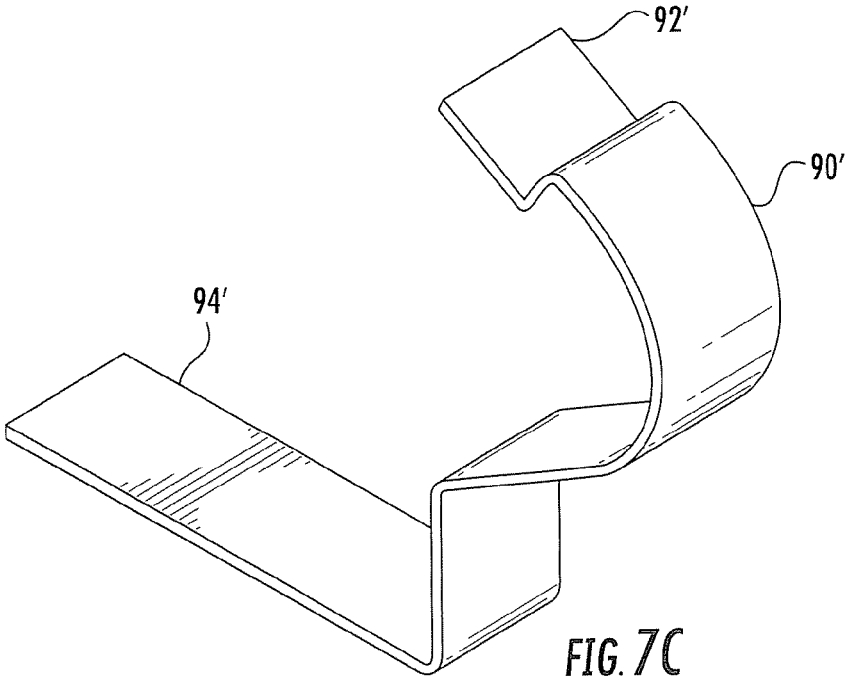
FIG. 7C is a side perspective view of a clip for securing the frame of the rain gutter protection device of FIGS. 1A and 1B to a gutter, according to some embodiments of the present invention.

Referring now to FIGS. 7B and 7C, the gutter protection device 10 of FIGS. 1A and 2-5 is illustrated in an installed configuration on a rain gutter 40, according to other embodiments of the present invention. The frame first edge portion 14 is positioned between the roof R of a building and the last row of shingles SH and the frame second edge portion 16 is positioned closely adjacent to a front edge 40*b* of the rain gutter 40. The frame second edge portion 16 is secured to the gutter 40 via a plurality of clips 90'. Each clip 90' has a first end 92' shaped to be attached to the frame second edge portion 16, as illustrated. Each clip 90' has a second end 94' that is shaped to be secured to a gutter support member 91. Gutter support member 91 may be any structural support member used to hang gutters to a building and/or to provide structural stability thereto. In the illustrated embodiment, the clip second end 94' is secured to the gutter support member 91 via a fastener 13 (e.g., a screw, rivet, bolt, etc.). In some embodiments the clip second end 94' may be adhesively secured to the gutter support member 91. The clip first end 92' is shaped to conform with a shape of the frame second edge portion 16, as illustrated. This allows the clip first end 92' to "press fit" or "snap in" with the frame second edge portion 16. A fastener 13 may be utilized, as illustrated, to secure the clip first end 92' to the frame 12, although a fastener may not be needed in some embodiments.

Figure 9:
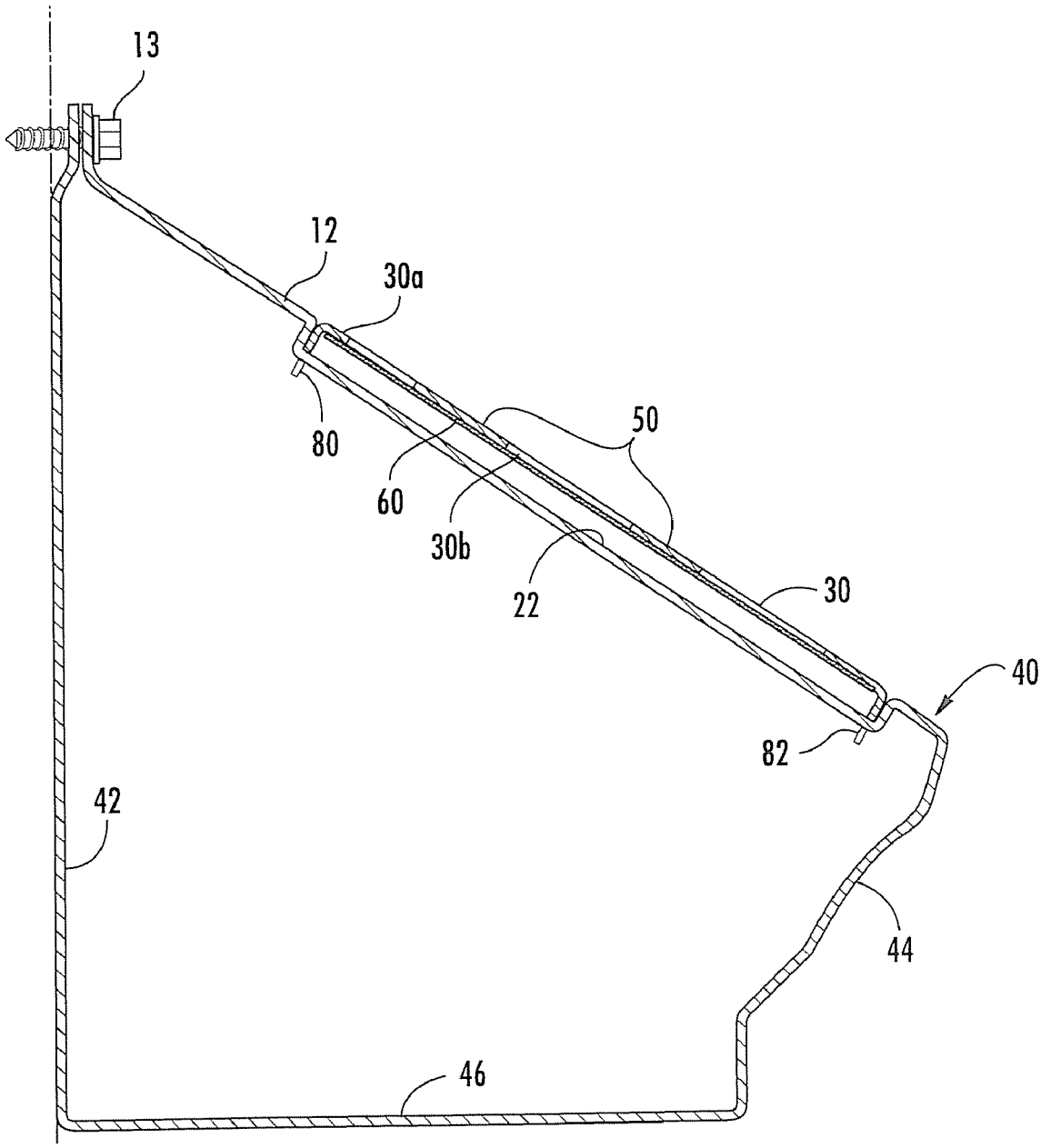
FIG. 9 is a side cross-sectional view of a rain gutter with an integral rain gutter protection device, according to some embodiments of the present invention.
Figure 10:
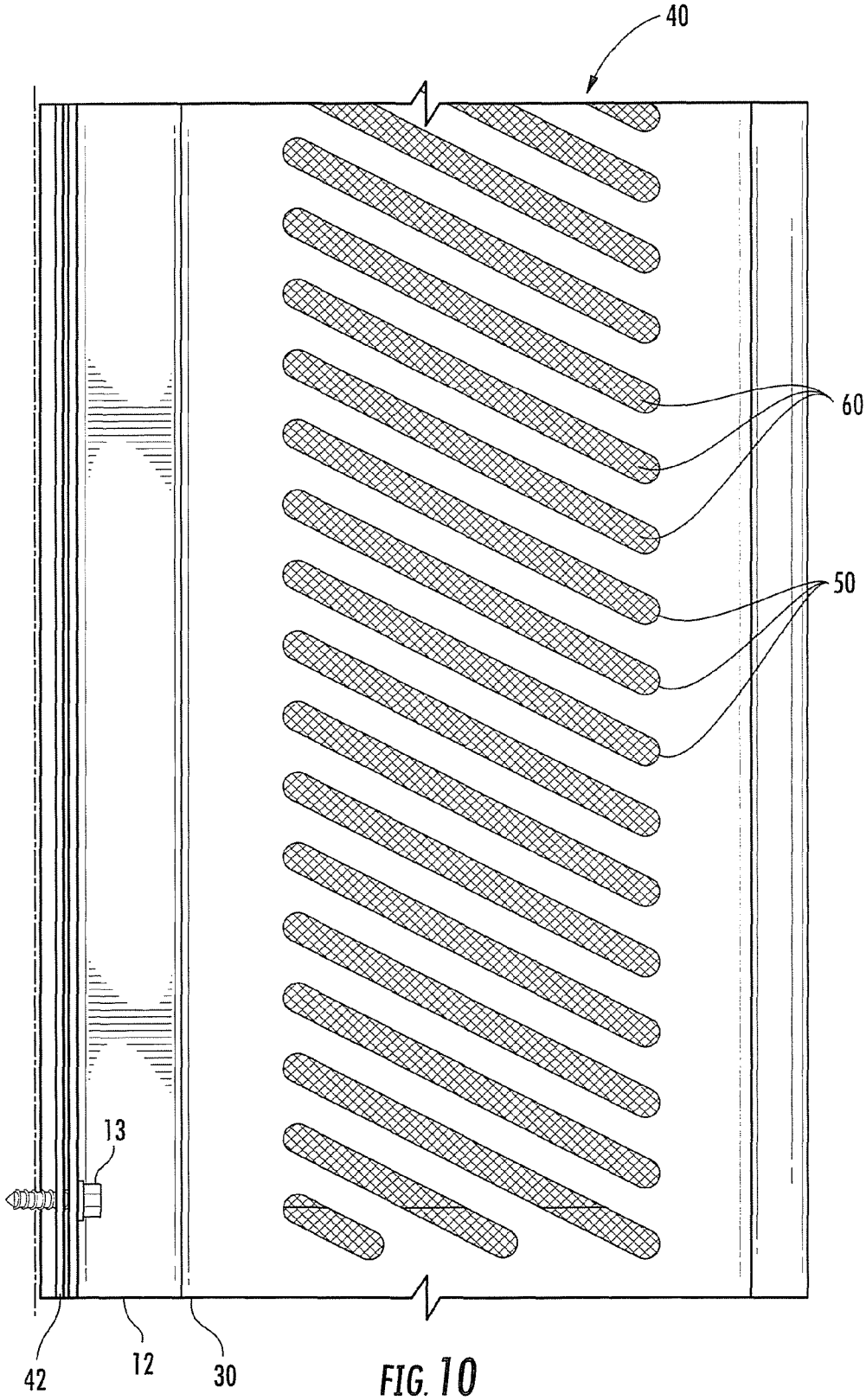
FIG. 10 is a partial top plan view of the rain gutter of FIG. 9.

According to other embodiments of the present invention, a gutter protection device may be an integral part of a rain gutter, for example, as illustrated in FIGS. 9-10. In the illustrated embodiment, the rain gutter 40 includes a rear wall 42, a front wall 44, and a bottom wall 46. The rear, front and bottom walls 42, 44, 46 define a trough therebetween for receiving water from a roof. A frame 12 extends between the front wall 44 and rear wall 42 to cover the trough. The frame 12 is configured to be secured to the rear wall via fasteners 13 (e.g., nails, screws, adhesives, etc.). The frame 12 has an elongated recessed portion 22 in a medial portion thereof, and includes a plurality of gutter access openings 26 arranged longitudinally in end-to-end spaced-apart relationship. As described above, each gutter access opening 26 is large enough to allow for gutter cleaning and maintenance.

A plurality of insert panels 30 are removably secured within the recessed portion 22 in end to end relationship. Each insert panel 30 has opposite first and second edge portions 32, 34, opposite first and second end portions 36, 38 and opposite upper and lower surfaces 30*a*, 30*b*, as described above. In addition, each insert panel 30 includes a plurality of spaced-apart openings 50 that permit water to flow into the gutter. A filtering screen 60 is secured to each insert panel lower surface 30*b* and covers all of the insert panel openings 50 and prevents the passage of debris therethrough.

The following exemplary claims are presented in the specification to support one or more devices, features, and methods of embodiments of the present invention. While not particularly listed below, Applicant preserves the right to claim other features shown or described in the application.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the teachings and advantages of this invention. Accordingly, all such modifications are intended to be included within the scope of this invention as defined in the claims. The invention is defined by the following claims, with equivalents of the claims to be included therein.

That which is claimed is:

1. A rain gutter protection device for mounting in an open top of a rain gutter, comprising:

an elongated frame having opposite first and second edge portions, opposite first and second end portions, and an elongated recessed portion in a medial portion of the frame that extends from the first end portion to the second end portion, wherein the recessed portion includes a plurality of gutter access openings arranged longitudinally in end-to-end spaced-apart relationship, wherein the frame is configured to extend laterally across the rain gutter open top and longitudinally along the length of the rain gutter such that the gutter access openings are in fluid communication with the rain gutter, and wherein each gutter access opening is large enough to allow for gutter cleaning and maintenance, wherein the recessed portion includes a first plurality of slots arranged in longitudinally spaced-apart relationship on one side of the gutter access openings, a second plurality of slots arranged in longitudinally spaced-apart relationship on an opposite side of the gutter access openings; and one or more insert panels removably secured within the recessed portion, wherein each insert panel comprises opposite first and second edge portions and opposite upper and lower surfaces, wherein the insert panel includes a plurality of spaced-apart openings that permit water to flow into the gutter, wherein each insert panel includes a first plurality of tabs extending from the insert panel lower surface in longitudinally spaced-apart relationship and a second plurality of tabs extending from the insert panel lower surface in longitudinally spaced-apart relationship, wherein the first and second plurality of tabs are configured to interlock with the respective first and second plurality of slots so as to removably secure the insert panel within the recessed portion.

2. The rain gutter protection device of claim 1, wherein the insert panel upper surface is substantially flush with an upper surface of the elongated frame.

3. The rain gutter protection device of claim 1, wherein the insert panel has an arcuate configuration such that the insert panel bows upwardly away from the frame.

4. The rain gutter protection device of claim 1, wherein an elongated first wall extends outwardly from the insert panel lower surface along the insert panel first edge portion, and an elongated second wall extends outwardly from the insert panel lower surface along the panel second edge portion, wherein the first and second walls are dimensioned to maintain the insert panel upper surface substantially flush with an upper surface of the elongated frame.

5. The rain gutter protection device of claim 1, wherein a filtering screen is secured to the insert panel lower surface and covers the insert panel openings, wherein the filtering screen is configured to prevent the passage of debris therethrough.

6. The rain gutter protection device of claim 5, wherein the filtering screen is adhesively secured to the insert panel lower surface.

7. The rain gutter protection device of claim 5, wherein the insert panel openings comprise elongated slots.

8. The rain gutter protection device of claim 7, wherein the slots are parallel to one another and extend at an acute angle relative to the insert panel first edge portion.

9. The rain gutter protection device of claim 7, wherein each slot extends at an angle of between about 30° and 60° relative to the insert panel first edge portion.

10. The rain gutter protection device of claim 1, wherein the frame second edge portion has a convex configuration and is positioned closely adjacent to a front edge of the rain gutter, wherein water flowing over the gutter protection device flows around the second edge portion and into the gutter.

11. The rain gutter protection device of claim 1, wherein each of the first and second plurality of tabs is "L" shaped.

12. The rain gutter protection device of claim 1, wherein the frame first edge portion has a planar configuration.

13. The rain gutter protection device of claim 1, in combination with a clip having a first end shaped to be attached to the gutter protection device second edge portion and a second end shaped to be attached to the rain gutter.

14. The rain gutter protection device of claim 1, wherein the frame recessed portion has a rectangular configuration, and wherein each insert panel has a corresponding rectangular configuration.

15. The rain gutter protection device of claim 1, comprising a plurality of insert panels removably secured within the recessed portion in end to end relationship.

16. The rain gutter protection device of claim 1, wherein each gutter access opening has a substantially rectangular configuration with a width of between about one inches and about six inches.

17. A rain gutter protection device for mounting in an open top of a rain gutter, comprising:

an elongated frame having opposite first and second edge portions, opposite first and second end portions, and an elongated recessed portion in a medial portion of the frame that extends from the first end portion to the second end portion, wherein the recessed portion includes a plurality of gutter access openings arranged longitudinally in end-to-end spaced-apart relationship, a first plurality of slots arranged in longitudinally spaced-apart relationship on one side of the gutter access openings, and a second plurality of slots arranged in longitudinally spaced-apart relationship on an opposite side of the gutter access openings, wherein the frame is configured to extend laterally across the rain gutter open top and longitudinally along the length of the rain gutter such that the gutter access openings are in fluid communication with the rain gutter, and wherein each gutter access opening is large enough to allow for gutter cleaning and maintenance;

a plurality of insert panels removably secured within the recessed portion in end to end relationship, wherein each insert panel comprises opposite first and second edge portions and opposite upper and lower surfaces, wherein each insert panel includes a plurality of spaced-apart openings that permit water to flow into the gutter, wherein a first plurality of tabs extend from each insert panel lower surface in longitudinally spaced-apart relationship along the first edge portion thereof and a second plurality of tabs extend from each insert panel lower surface in longitudinally spaced-apart relationship along the second edge portion thereof, wherein the first and second plurality of tabs are configured to interlock with the respective first and second plurality of slots so as to removably secure a respective insert panel within the recessed portion; and a filtering screen secured to each insert panel lower surface, wherein the filtering screen covers all of the insert panel openings and prevents the passage of debris therethrough.

18. The rain gutter protection device of claim 17, wherein the insert panel openings comprise elongated slots.

19. The rain gutter protection device of claim 18, wherein the slots are parallel to one another and extend at an acute angle relative to the insert panel first edge portion.

20. The rain gutter protection device of claim 17, wherein the frame second edge portion has a convex configuration, and wherein the frame first edge portion has a planar configuration.

21. A rain gutter, comprising:

a rear wall, a front wall, and a bottom wall, the rear, front and bottom walls defining a trough therebetween;

a frame extending between the front wall and rear wall to cover the trough, the frame having an elongated recessed portion in a medial portion thereof, wherein the recessed portion includes a plurality of gutter access openings arranged longitudinally in end-to-end spaced-apart relationship, wherein each gutter access opening is large enough to allow for gutter cleaning and maintenance, a first plurality of slots arranged in longitudinally spaced-apart relationship on one side of the gutter access openings, and a second plurality of slots arranged in longitudinally spaced-apart relationship on an opposite side of the gutter access openings;

a plurality of insert panels removably secured within the recessed portion in end to end relationship, wherein each insert panel comprises opposite first and second edge portions and opposite upper and lower surfaces, wherein each insert panel includes a plurality of spaced-apart openings that permit water to flow into the gutter, wherein a first plurality of tabs extend from each insert panel lower surface in longitudinally spaced-apart relationship along the first edge portion thereof and a second plurality of tabs extend from each insert panel lower surface in longitudinally spaced-apart relationship along the second edge portion thereof, wherein the first and second plurality of tabs are configured to interlock with the respective first and second plurality of slots so as to removably secure a respective insert panel within the recessed portion; and a filtering screen secured to each insert panel lower surface, wherein the filtering screen covers all of the insert panel openings and prevents the passage of debris therethrough.

* * * * *